United States Patent [19]

Kurz

[11] 4,161,204

[45] Jul. 17, 1979

[54] MOTORIZED SMOKE AND FIRE DAMPER

[76] Inventor: John C. Kurz, 200 Red Lion Rd., Philadelphia, Pa. 19115

[21] Appl. No.: 875,390

[22] Filed: Feb. 6, 1978

Related U.S. Application Data

[63] Continuation of Ser. No. 833,160, Sep. 14, 1977.

[51] Int. Cl.[2] ..... E05F 15/20

[52] U.S. Cl. ..... 160/1; 160/84 R

[58] Field of Search ..... 160/1, 5, 6, 317, 318, 160/310, 84 R

[56] References Cited

U.S. PATENT DOCUMENTS

| | | | |
|---|---|---|---|
| 1,709,305 | 4/1929 | Brunst et al. | 160/317 |
| 3,580,321 | 5/1971 | Root | 160/1 |
| 3,665,996 | 5/1972 | Roberts | 160/1 |
| 3,866,656 | 2/1975 | McCabe | 160/1 |

*Primary Examiner*—Peter M. Caun

*Attorney, Agent, or Firm*—Weiser, Stapler & Spivak

[57] ABSTRACT

A motorized smoke and fire damper including a peripheral frame suitable for mounting within a duct and a plurality of interlocking blades movable within the frame from an open position to a closed position. A normally energized motor is affixed to the frame either inside or outside of the duct to constantly urge a pulley to a stall position. A cable or cables attach to the pulley and are normally retained taut by the motor operation. The cables incorporate a fusible link and are connected to retain the blade assembly in the open position. Interruption of line current to the motor, such as in response to signals transmitted by a smoke detector sensing device, releases the pulley and the attached cables to thereby allow the blade assembly to drop by gravity to the closed position. The blade assembly is also responsive to the presence of heat within the duct upon fusing of the fusible link.

8 Claims, 7 Drawing Figures

FIG. 1
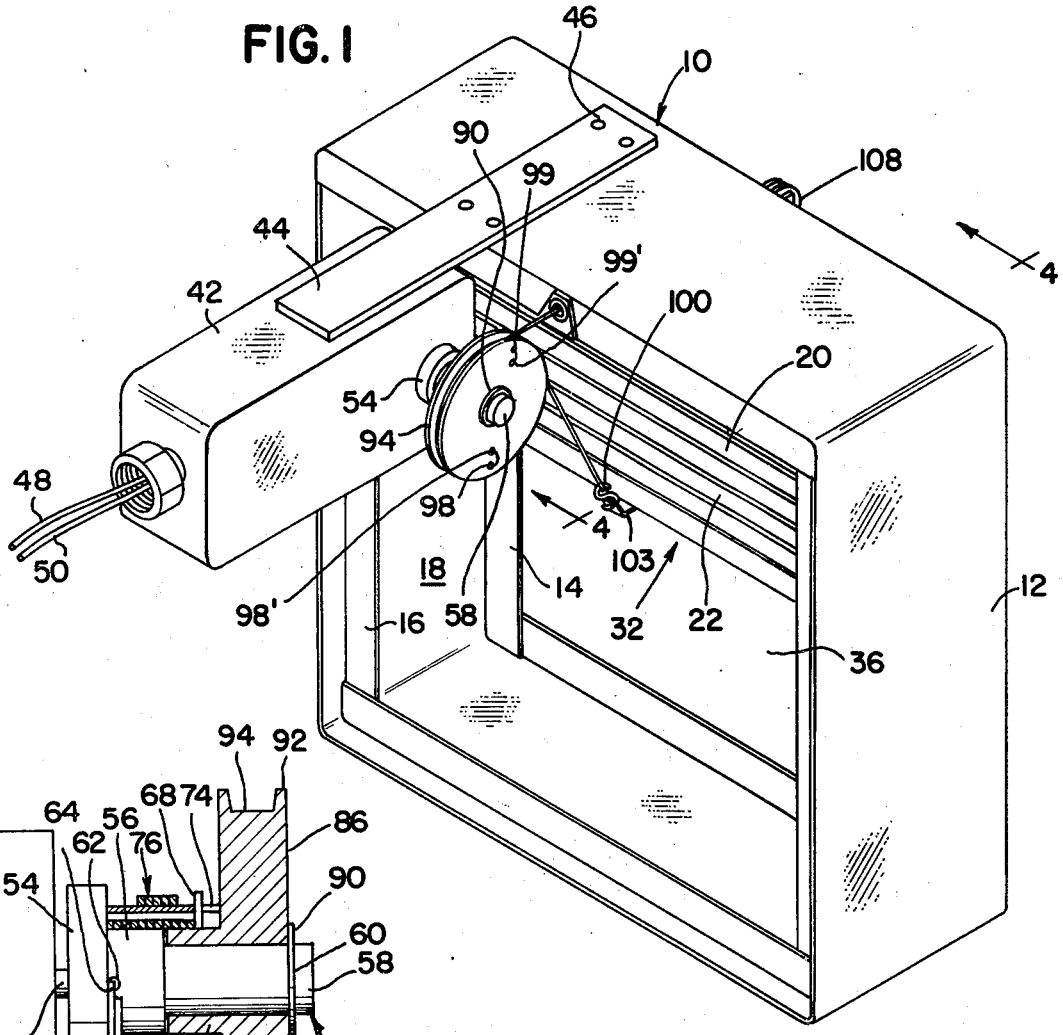
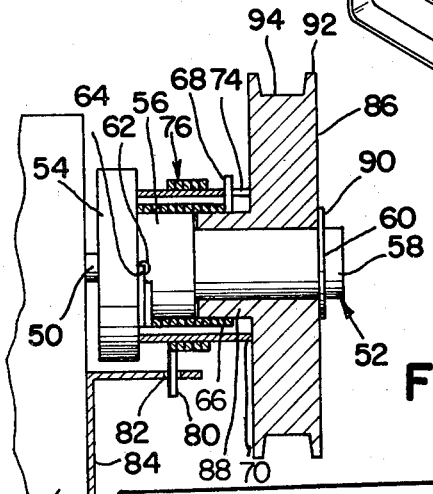
FIG. 3
FIG. 2
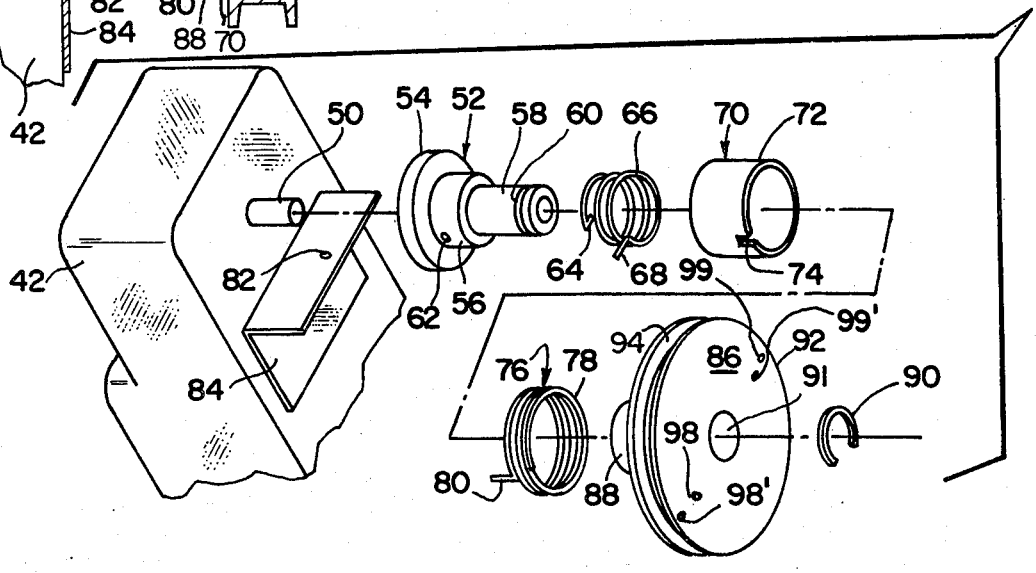

MOTORIZED SMOKE AND FIRE DAMPER

This is a continuation of application Ser. No. 833,160 filed Sept. 14, 1977.

BACKGROUND OF THE INVENTION

This invention relates generally to the field of safety devices, and more particularly, is directed to a motorized smoke and fire damper which is designed to function upon detection of the presence of smoke or heat.

Fire dampers have long been employed in connection with air conditioning, heating and ventilating duct work systems for fire protection purposes to prevent the spread of fire within the duct work from one fire separation to an adjacent fire separation and from floor to floor. In this manner, safety devices have been provided which are automatically responsive to heat to contain a fire within the area of incidence. Most of the prior art types of fire dampers which have been commonly employed in building construction utilize an enclosing frame which is affixed directly to the duct system and a blade assembly operable within the frame which is suitable to close the duct opening defined within the frame. Blade assemblies of the horizontally pivoting type and of the interlocking curtain type are most popular and have been most commonly employed in prior art duct systems. Fusible elements are employed to maintain the blade assembly in the open position during all normal periods of use. Upon sensing high temperatures within the duct system, the fusible element fuses to thereby release its blade assembly to close the duct opening, thereby preventing the passage of heat and fire through the fire damper from one fire division to another.

Experience with the prior art fire damper designs has proved that the average fire damper installation as presently in use and as generally approved by applicable governmental agencies and insurance carriers will not quickly react to the presence of smoke. Rather, the dampers are responsive only to the build up of sufficient heat, a condition which causes considerable delay between the first incidence of fire and the operation of the fire damper. Additionally, there are many reported incidences of smoldering type fires which generate dangerous quantities of smoke, but which do not build up sufficient heat to actuate the presently available fire damper equipment.

Recently, tests have been conducted and investigations have been made under actual fire conditions using relatively sophisticated test instruments. It has been determined that in most instances, the buildings subject to fire become untenable from smoke long before they are untenable due to the elevated temperatures caused by a fire. Because of this added awareness, much thought has been given recently to personnel protection in buildings. In accordance with and as a direct result of these recent studies, safety from smoke considerations now form an important building design parameter. However, despite the knowledge that smoke can be a killer, to this date, no satisfactory system has been developed to actually rapidly react to the presence of smoke to prevent the further spread of smoke through building ductwork. Numerous smoke detection devices have been developed and these devices are quite reliable and are in general use. However, the prior art smoke detection systems as presently available, have until now, been employed only to trigger alarm systems to thereby warn the building's occupants of the presence of smoke. No system has heretofore been available to permit a detector of smoke or heat to also automatically trigger a building occupant protective system. By utilizing a motorized smoke and fire damper in accordance with the present invention and by wiring the device to a detector unit, fires can now be detected at early stages by the available smoke or products of combustion detection devices and the smoke dampers could be automatically activated through electrical stimuli generated by the detectors. In this manner, early detection can be utilized to function smoke dampers to prevent the spread of smoke in a building through the air conditioning, ventilating or heating duct systems.

SUMMARY OF THE INVENTION

The present invention relates generally to improvements in smoke and fire dampers and more particularly is directed to an electrically actuated motorized damper which is rapidly responsive to the presence of smoke within a building to close the damper opening within a duct system.

The rapid detection and prompt activation of smoke dampers within air conditioning and other duct systems by the early, automatic closure of smoke dampers within building duct systems can save precious moments that may make the difference between life and death for the occupants in the immediate fire zone or in building areas adjacent to the fire zone. The electrically actuated smoke and fire damper of the present invention will furnish an effective, low cost solution to the problem of providing rapid smoke damper reaction to the presence of smoke in very early stages of a fire. In addition to saving lives, the present system will result in substantial reduction of property losses which would normally result from fire and smoke damage.

The present invention includes a fire damper frame of the type generally disclosed in U.S. Pat. No. 3,327,766 having a blade assembly comprising a plurality of interlocking steel blades which are movable within a peripheral frame from an open position to a closed and locked position. An electrical motor is mounted upon a bracket which is affixed to the frame and which is wired to continuously rotate a pulley for cable tensioning purposes. A cable or cables, which may be in the form of a thin, stainless steel, strong wire have one end thereof connected to a fusible link which is positioned to retain the blade assembly in open position and to be impinged upon by the air stream traveling within the duct and through the damper opening. The cable or cables are suitably suspended within the frame construction to normally retain the blade assembly in the open position and have the second end or ends affixed to the pulley. The continuous operation of the motor continuously tensions the cable or cables to thereby maintain the blade assembly in the open position.

The motor is wired to be responsive to a detecting device, such as a smoke detector. Under normal conditions, the motor will continuously bias the pulley for cable tensioning purposes to thereby maintain the blade assembly in the open position. Upon detection of smoke by the smoke detector, the motor circuit will deactivate, thereby releasing cable tension. In this condition, the weight of the blade assembly and any springs which may be associated therewith, act to close the damper opening by moving the blade assembly to its closed position. It will be noted that a fusible link is associated with the cable system and is suspended in the air stream in the usual manner. Accordingly, should high temperatures be present within the duct system itself, the fusible link will operate conventionally to release the cable system thereby allowing the damper to function in the usual manner as a conventional fire damper.

It is an object of the present invention to provide an improved motor operated smoke and fire damper of the type set forth.

It is another object of the present invention to provide a novel motorized smoke and fire damper incorporating cable means which are continuously tensioned by a motor to normally retain the damper blade assembly in an open condition and which automatically acts to release the blade assembly upon de-energization of the motor.

It is another object of the present invention to provide a novel motorized smoke and fire damper incorporating an electric motor which is responsive to signals generated by an exterior smoke detector and which functions cable means to permit automatic closing of the blade assembly of the damper.

It is another object of the present invention to provide a novel smoke and fire damper having a blade assembly operable therein from an open position to a closed position and having a motor mounted on the damper frame to permit movement of the blade assembly from the open position to the closed position upon detection of the presence of smoke.

It is another object of the present invention to provide a novel motorized smoke and fire damper including a damper frame and a blade assembly movable within the frame from an open position to a closed position, a continuously operating motor functioning a pulley, and a cable means having one end attached to the pulley and one end attached to a fusible link, the said cable having suitable suspension to normally maintain the blade assembly in the open position while the motor is energized, the said motor being responsive to an exteriorly positioned smoke detector to automatically release the pulley and the attached cable means upon detection of the presence of smoke.

It is another object of the present invention to provide a novel smoke and fire damper incorporating a peripheral frame, a blade assembly movable within the frame from an open position to a closed position and cable means responsive to motor operation to permit movement of the blade assembly within the frame, wherein the motor may be mounted either within or without the air stream.

It is another object of the present invention to provide a novel motorized smoke damper including a damper frame and means to mount a motor to the frame for damper blade operation, wherein the said means mounts the motor within the duct air stream.

It is another object of the present invention to provide a novel motorized smoke damper wherein the said means mounts the motor exteriorly of the duct air stream.

It is another object of the present invention to provide a novel motorized smoke and fire damper that is rugged in construction, rapid in operation and trouble free when in use.

Other objects and a fuller understanding of the invention will be had by referring to the following description and claims of a preferred embodiment thereof, taken in conjunction with the accompanying drawings, wherein like reference characters refer to similar parts throughout the several views and in which:

BRIEF DESCRIPTION OF THE DRAWINGS

FIG. 1 is an isometric view of the device showing the blade assembly being retained in open position.

FIG. 2 is an exploded, enlarged, isometric view of the pulley operating mechanism.

FIG. 3 is an enlarged, cross sectional view of the pulley operating mechanism taken along line 3—3 of FIG. 4, looking in the direction of the arrows.

DESCRIPTION OF THE PREFERRED EMBODIMENT OF THE INVENTION

Figure 4:
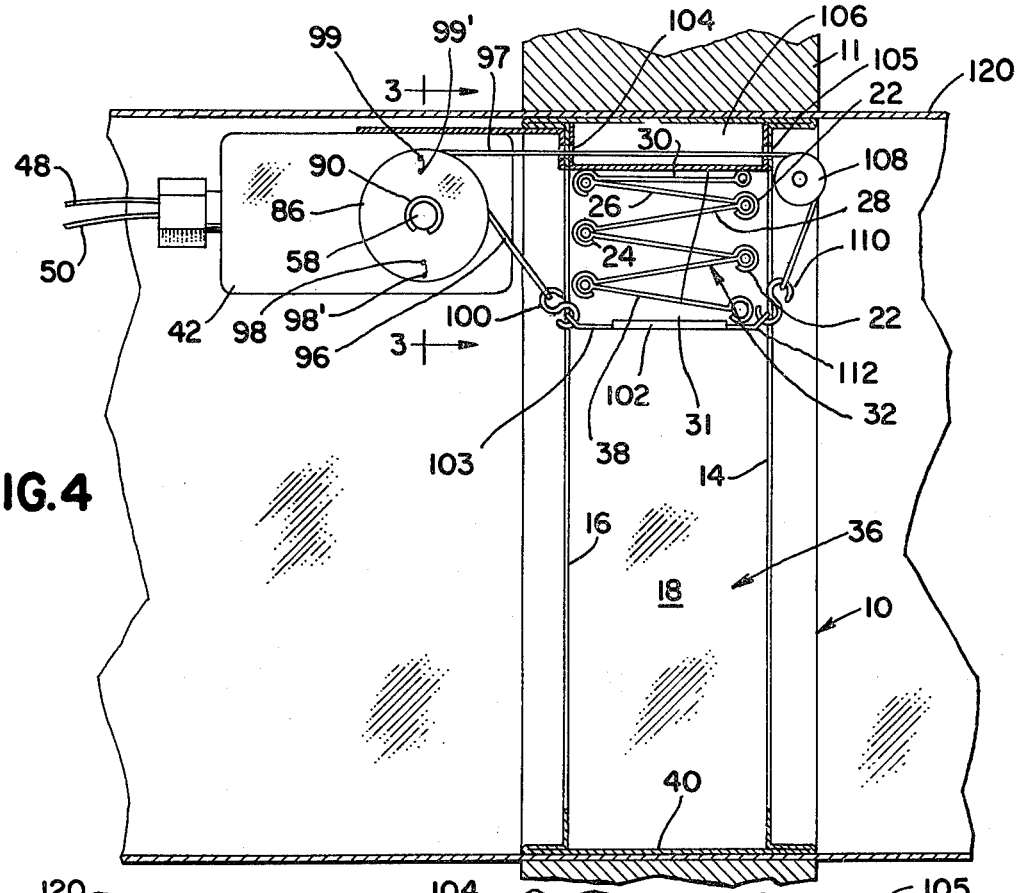
FIG. 4 is a cross sectional view taken along line 4—4 of FIG. 1, looking in the direction of the arrows, showing the motor mounted within the duct air stream.

Although specific terms are used in the following description for the sake of clarity, these terms are intended to refer only to the particular structure of my invention selected for illustration in the drawings and are not intended to define or limit the scope of the invention.

Figure 5:
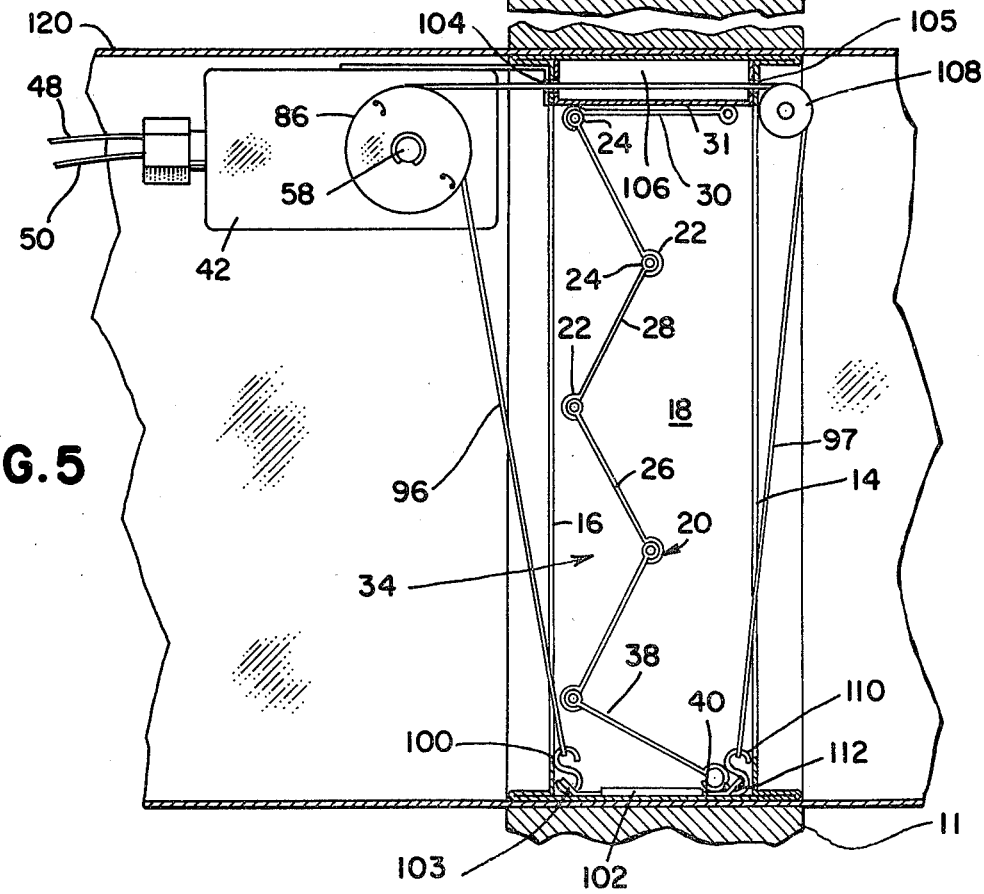
FIG. 5 is a view similar to FIG. 4 showing the position of parts upon deactivation of the damper motor.

Referring now to the drawings, there is shown in FIGS. 1, 4 and 5 a motorized smoke and fire damper 10 which comprises generally a frame 12 which is suitably formed to provide forward and rearward flanges 14, 16. The flanges 14, 16 define an interior channel 18 within which is guided a plurality of fire damper blades 26, 28 in the form of a pivotally interconnected blade assembly 20. The damper 10 is particularly suitable for protecting duct openings through a fire wall 11 either with or without a sleeve (not shown).

In accordance with usual fire damper and smoke damper construction, the blades 20 are preferably of the interlocking steel blade type wherein the horizontal marginal edges 22, 24 of adjacent blades 26, 28 are suitably formed to interfit and interlock to permit rotary engagement whereby each blade 26 is freely pivotal about its adjacent blade 28. In the present embodiment, the uppermost blade 30 is riveted to a false housing 31 which connects to the top of the frame 12 and is always securely fastened in position. The remaining blades 26, 28 of the blade assembly 20 pivotally interlock and are movable from a compacted position 32 as illustrated in FIGS. 1 and 4, to the closed and locked position 34 as illustrated in FIG. 5. When the blades are in the compacted position 32, the blade assembly 20 defines a damper opening 36 through the frame 12 of sufficient size to normally permit passage of the air stream from an air conditioning, heating or ventilating duct system 120. When the blades drop to the closed position 34 as in FIG. 5, the damper opening 36 is effectively closed by the blade assembly to prevent the passage of heat, smoke, fire or other dangerous conditions through the duct system 120 therethrough. The lowest blade 38 bottoms against the floor 40 of the frame 12 and can be locked thereto in a manner well known to those skilled in the art when the blade assembly is functioned by detection of either heat or smoke to the closed position 34.

A cable tensioning means comprises a stall point motor 42 which is mounted upon the frame 12 in conventional manner such as by employing a suitable mounting bracket 44. The mounting bracket 44 is rigidly affixed to the frame 12 in conventional manner, such as by employing a plurality of rivets 46. As best seen in FIGS. 1, 4 and 5, the motor 42 is conventionally activated through electrical circuit wires 48, 50 and may be wound for either low voltage or line voltage operation, depending upon job requirements. The motor is normally continuously energized by a continuous flow of electrical energy to rotate the motor shaft 50. A pulley engaging means includes a step spindle 52 which is pinned or otherwise secured to the motor shaft 50 and is rotated thereby. The spindle includes a cylindrical base 54, and a barrel 56 extending from the base 54, the barrel and base preferably being integrally formed. The barrel 56 terminates outwardly in an integral, concentric shaft 58 of smaller diameter. The spindle shaft 58 is outwardly machined to provide a peripheral groove 60 for assembly purposes as hereinafter more fully set forth. The base of the barrel 56 near its connection to the cylindrical spindle base 54 is provided with an opening 62 which receives therein the inner end 64 of the first coil spring 66 in stationary engagement. The first spring 66 coils about the barrel 56 and when untensioned, is a loose fit thereabout.

A bushing 70 of generally hollow, cylindrical configuration overfits the first spring 66 and seats upon the stepped spindle base 54. The outer edge 72 of the bushing 70 is provided with a notch 74 which receives therein the outwardly turned end 68 of the first spring 66. Thus the first spring 66, when untensioned, interconnects between the opening 62 in the spindle 52 and the notch 74 of the bushing 70. A second coil type spring 76 has its body 78 coiled about the outer periphery of the bushing 70 and is a sliding fit thereabout. The spring 76 terminates at one end in a bent connector 80 which engages within the opening 82 provided in the L-shaped bracket 84. The bracket 84 is rigidly secured to the motor 42 in a well known manner such as by riveting or bolting. The sliding engagement of the spring body 78 over the bushing 70 permits the bushing to rotate relative to the second spring 76 when the device is activated in the manner hereinafter more fully set forth.

A pulley 86 is provided with an inwardly facing, concentric hub 88 and a concentric, axial opening 91 which extends completely through the pulley 86 and the hub 88 and slidingly overfits the shaft 58 of the stepped spindle 52. A C-shaped clip 90 presses into the groove 60 which is provided at the end of the shaft 58 and acts to retain all of the parts in operating position. Preferably, the exterior periphery 92 of the pulley 86 is machined to provide a peripheral groove 94 to retain the operating cables 96, 97 in wound relation thereabout for damper operating purposes. The cables 96, 97 which may be a thin, flexible, stainless steel or other wire of sufficient strength affix to a portion of the pulley 86 by respectively threading through pairs of cable connecting holes 98, 98' and 99, 99' which are drilled through the pulley body.

In operation, the motor 42 is normally energized to rotate its shaft 50 to a stall point for cable 96, 97 tensioning purposes. The step spindle 52 is pinned or otherwise conventionally affixed to the shaft 50 and rotates as the shaft is rotated by function of the motor 42. Rotation of the spindle 52 winds the first spring 66 by means of its connected inner end 64 and the seated outerwardly turned end 68. Winding of the first spring 66 upon operation of the motor 42 results in a decrease in spring diameter which causes the spring body to grip the inwardly directed hub 88 of the pulley 86. The greater the turning moment caused by the motor shaft 50, the tighter the spring will lock upon the pulley hub 88 to rotate the pulley to a stall position and to lock the pulley in this position. Thus, when the motor 42 is energized, the pulley will normally be rotated to the stall position as illustrated in FIGS. 1 and 4 and the cables 96, 97 will wind about the peripheral groove 94 sufficiently to hold the blade assembly in the compacted position 32.

When current to the motor 42 is interrupted, such as by function of an externally located smoke detector or heat detector (not shown), the motor shaft will cease turning the spindle 50 and the first spring 66 will tend to unwind due to its natural spring bias. Unwinding of the first spring 66 releases the pulley hub 88 and allows the pulley 86 to immediately become freely rotatable about the spindle shaft 58. In this condition, tension on the cables 96, 97 would be released to thereby allow the blade assembly 20 to drop to the closed position 34 as in FIG. 5. The bushing 70 overfits the first spring 66 and by means of the second, outer spring 76, provides sufficient initial spring tension to initiate tensioning the first spring 66 upon energization of the motor 42. The second spring 76 initially frictionally holds the bushing 70 until the first spring 66 tightly grips the hub 88. After the first spring 66 locks upon the hub 88, the bushing 70 will rotatively slip relative to the outer spring 76.

Referring now to FIGS. 4 and 5, the cable 96 has one end connected to the pulley 86 at the connecting holes 98, 98' and has its other end connected to the fusible link 102 below the lowest blade 38. The cable 96 terminates in an S-link 100 and the other end of the link 100 is attached to a fusible element 102 by a suitable metallic strap 103. The second cable 97 is affixed at one end to the pulley 86 at connecting holes 99, 99'. The cable 97 is threaded through the guide hole 104 through the space 106 defined between the false head 31 and the top of the frame 12 and through the second guide hole 105. The cable 97 then passes about the frame connected pulley 108 and terminates at the second S-link 110. A second metallic strap 112 interconnects the link 110 with the fusible element 102. Thus, when the motor 42 rotates the pulley 86 to the stall position as in FIG. 4, the cables 96, 97 are suitably tensioned by winding about the pulley to pull the fusible element 102 to elevate the blade assembly 20 to the open position 32. In this position, the fusible element 102 can function in conventional manner to respond to heat passing through the damper opening 36. When the motor 42 is deenergized, such as by function of a smoke detector (not shown) or an exterior heat detector (also not shown), the pulley 86 unwinds the cables 96, 97 sufficiently to allow the blade assembly 20 to drop to the closed position 34 as illustrated in FIG. 5.

In the event that gases of temperatures elevated sufficiently to activate the fusible element 102 are present within the duct system 120, but sufficient smoke or heat necessary to activate an exterior smoke detector or heat detector (not shown) is not present to deactivate the motor 42, the fusible element 102 will fuse in the usual manner to thereby separate the cables 96, 97 which were joined at the element 102. The severing of the fusible element 102 would have the same effect in the system as deactivation of the motor 42 in that the cables 96, 97 would release the blade assembly 20. With the cables thus released, the blade assembly 20 would automatically move to its closed position 34 (see FIG. 5), either by action of the forces of gravity on the blade assembly 20 or by function of conventional damper blade assembly closing springs (not illustrated) which would function to bias the blade assembly to its closed position 34.

The embodiment illustrated in FIGS. 1, 4 and 5 shows the motor 42 mounted interiorly of the duct system 120. In this embodiment, the entire length of the cables 96, 97 are contained interiorly of the duct systems 120.

Figure 6:
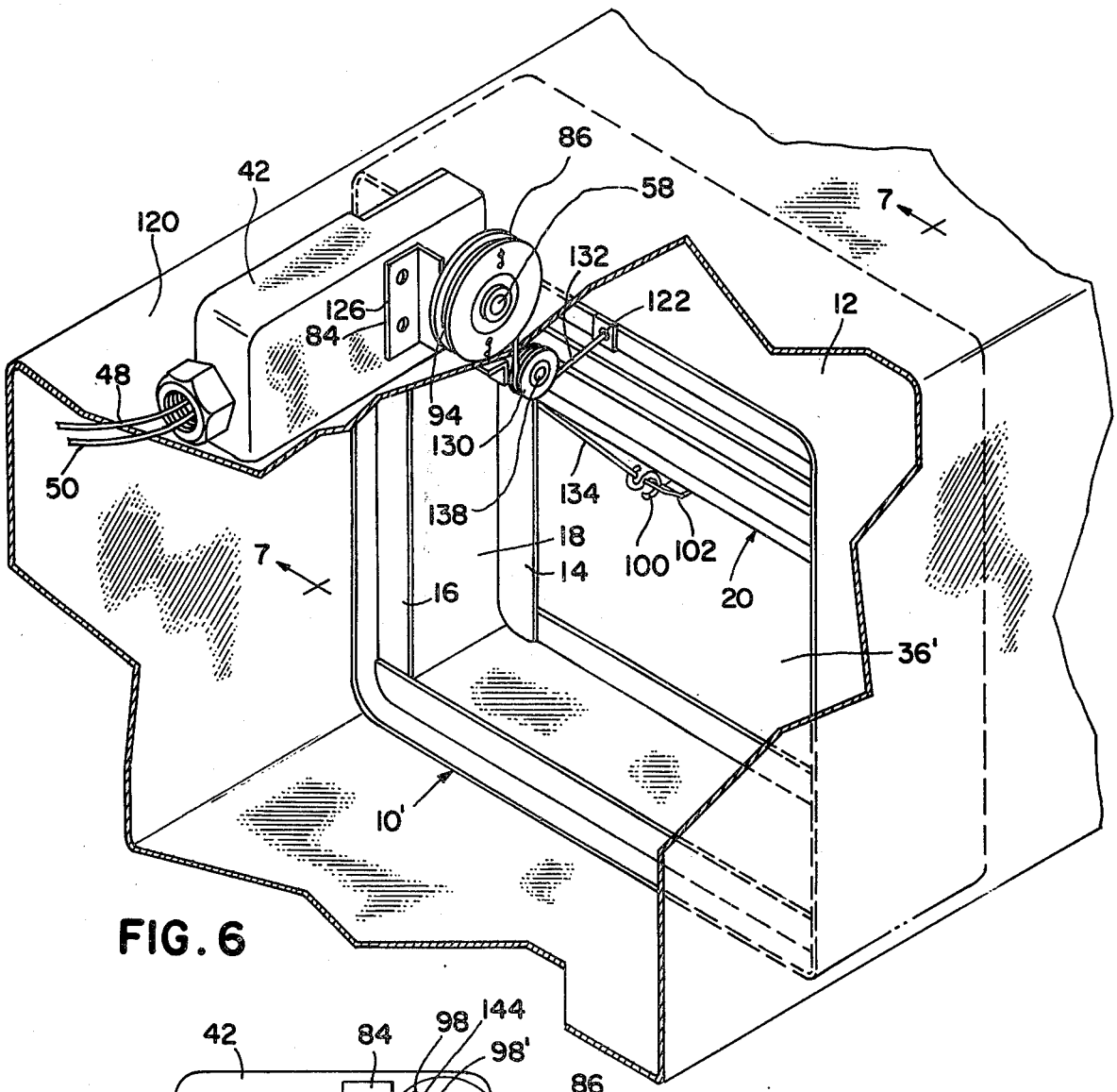
FIG. 6 is an isometric view of a modified motorized smoke damper with portions of the duct broken away to show details of interior construction.
Figure 7:
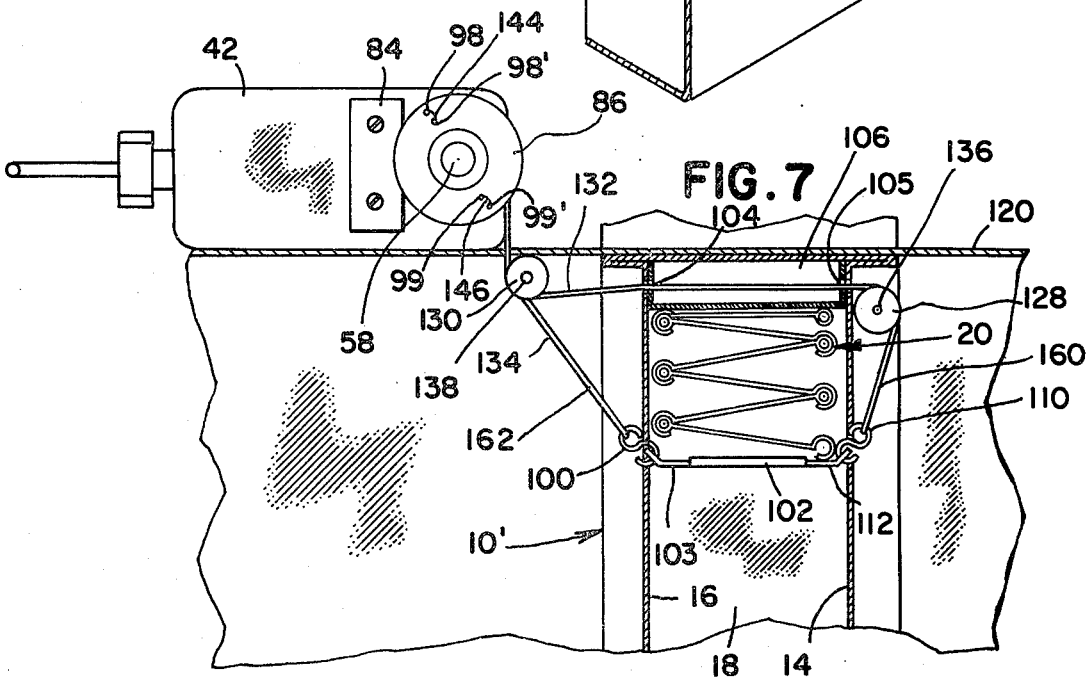
FIG. 7 is a cross sectional view taken along line 7—7 of FIG. 6, looking in the direction of the arrows.

In the embodiment illustrated in FIGS. 6 and 7, there is shown a modified smoke and fire damper 10' wherein the motor 42 is mounted out of the air stream passing through the damper opening 36'. As illustrated, the motor 42 is mounted above the damper 10' and exteriorly of the duct 120 with the longitudinal axis of the motor 42 in alignment with the axis of the duct. A bracket may be mounted on the top of the damper frame 12 and be secured thereto in well known manner, such as by riveting or spot welding for connecting the motor 42 to the damper frame in a mechanically secure and strong connection. The motor 42 rotates the drive pulley 86 through the shaft 54 in the manner hereinbefore set forth.

Respective upstream and downstream pulleys 128, 130 position near the motor 42 and the damper 10' to permit cables 132, 134 to function the blade assembly 20 without interference or binding. As best seen in FIG. 6, the pulley 128 is rotatively pinned to the damper 10' about the pivot pin 136. The cable pulley 130 is rotatively mounted on the damper frame 12 for rotation about its pivot pin 138. The pulley 130 preferably is mounted below the drive pulley 86 outwardly of the damper frame 12 and a suitable mounting bracket (not shown) can be employed for this purpose. The cables 132, 134 pass through the duct wall 120 intermediate the drive pulley 86 and the cable pulley 130. As illustrated, one end 144, 146 of each of the cables 132, 134 secures exteriorly to the pulley 86 at one of the respective pairs of openings 98, 98' and 99, 99' to allow the cables 132, 134 to wind about the pulley 86 when the motor 42 is energized. The cables 132, 134 extend from their respective ends 144, 146 about the pulley groove 94, thence over the pulley 130. The cable 134 passes about the pulley 130 and is connected to the S-link 100. The cable 132 passes about the pulley 130, thence through the upper damper openings 104, 105, about the pulley 128 and is connected to the second S-link 110. Each S-link 100, 110 respectively connects to an end of the fusible link 102 through the end straps 103, 112 in the manner hereinbefore set forth.

As best seen in FIG. 7, the cable 134 is run from the pulley 86 about the pulley 130 and thence downwardly to engage the S-link 100. Similarly, the cable 132 extends from its secured end 146 over the pulley 130, through the header space 106, about pulley 128 to engage the other S-link 110. Suitable grommets 122, preferably fabricated of hardened material, such as ceramic, are employed at the openings 104, 105 to lead the cable 132 through the false header space 106 in a smooth manner without binding and without injury to the cable. The respective second ends 160, 162 of the cables 132, 134 downwardly engage opposite ends of a fusible element 102 at the respective S-links 100, 110 in suitable manner to circle the blade assembly 20 to permit motor 42 operation thereof.

In the manner hereinbefore set forth, when the motor 42 is energized, which is its normal condition, the pulley 86 will be wound to its stall position to wind the cables 132, 134 within the pulley groove 94. The cables 132, 134 turn about the pulleys 128, 130 and pull the blade assembly 20 upwardly to the open position as illustrated in FIG. 7. Upon activation of a remote positioned environmental sensor (not shown) such as a smoke detector, heat detector or products of combustion detector, the electrical current supply to the motor will be interrupted, thereby releasing the motor pulley 86 and the attached cables or wires 132, 134. The cables 132, 134 will play out from the motor pulley 86 and thus permit the blade assembly 20 to drop downwardly within the space defined by the damper flanges 14, 16 to thereby effectively close the opening 36' through the smoke and fire damper 10'.

Although the present invention has been described with reference to the particular embodiments therein set forth, it is understood that the present disclosure has been made only by way of example and that numerous changes in the details of construction may be resorted to without departing from the spirit and scope of the invention. Thus, the scope of the invention should not be limited by the foregoing specification, but rather only by the scope of the claims appended hereto.

I claim:

1. In a smoke and fire damper mounted within an air duct of the type including a frame and a blade assembly movable from an open position to define a damper opening within the frame to a closed position, wherein the damper opening is closed, the combination of a cable tensioning means positioned adjacent the frame to tension a cable, said cable tensioning means functioning from a first position to a second position, the said cable tensioning means being positioned exteriorly of the air duct and above the frame, said cable tensioning means comprising a motor affixed to the frame and adapted to rotate a spindle, said spindle including a step portion and an engagement for engaging a first spring, a cable winding pulley rotatable about the spindle and including a hub abutting the spindle step portion, a bushing loosely overfitting the pulley hub and the spindle step portion, said bushing being provided with a second engagement and being adapted to rotate freely of the hub and the said step portion, a first coil spring interposed between the spindle and the bushing and having a first end engaged with the spindle engagement and a second end engaged with the second engagement, and frictional means to retard rotation of the bushing when the spindle is rotated whereby the first coil spring is tensioned sufficiently to continuously engage the spindle step portion and the hub upon operation of the motor to continuously tend to rotate the pulley, the pulley being adapted to rotate freely of of the spindle and the bushing upon deactivation of the motor.

2. The smoke and fire damper of claim 1 wherein the motor is stationary.

3. The smoke and fire damper of claim 1 wherein the said first spring has an initial untensioned diameter that is greater than the diameter of the step portion and the hub when the cable means is functioned to its second position upon deactivation of the motor.

4. The smoke and fire damper of claim 3 wherein the first spring diameter is reduced from its initial diameter when the spindle connected end of the first spring is rotated by the motor to the first position, and wherein the reduction in first spring diameter causes the first spring to lock upon the hub of the pulley and the spindle to thereby rotate the pulley as the spindle is rotated.

5. The smoke and fire damper of claim 3 wherein the initial diameter of the first spring is great enough to permit the hub of the pulley to slip relative to the untensioned first spring when the cable tensioning means is functioned to its said second position.

6. The smoke and fire damper according to claim 1 wherein the frictional means comprises a second spring frictionally engaging the bushing, said second spring retarding rotation of the bushing until the first spring tightly grips the said hub of the pulley.

7. The smoke and fire damper according to claim 6 wherein the second spring comprises a fixed end to prevent rotation of the spring, the fixed end being stationarily affixed relative to the frame.

8. The smoke and fire damper according to claim 1 wherein the motor is continuously energized and is adapted to continuously tend to rotate the spindle to urge the blade assembly to the said open position.

* * * * *